US008617460B2

(12) United States Patent
Mitchell et al.

(10) Patent No.: US 8,617,460 B2
(45) Date of Patent: Dec. 31, 2013

(54) GAS HEATER

(75) Inventors: Ian Edward Mitchell, South Yorkshire (GB); Daniel Clark, Derby (GB); Stephen John Tuppen, South Derbyshire (GB)

(73) Assignee: Rolls-Royce PLC (GB)

( * ) Notice: Subject to any disclaimer, the term of this patent is extended or adjusted under 35 U.S.C. 154(b) by 103 days.

(21) Appl. No.: 12/342,103

(22) Filed: Dec. 23, 2008

(65) Prior Publication Data

US 2009/0173416 A1 Jul. 9, 2009

(30) Foreign Application Priority Data

Jan. 8, 2008 (GB) ..... 0800294.1

(51) Int. Cl.
*C22F 1/16* (2006.01)
*F27B 5/16* (2006.01)

(52) U.S. Cl.
USPC ..... 266/251; 148/712

(58) Field of Classification Search
USPC ..... 266/251, 252, 249, 250, 259; 219/400, 219/389; 432/59, 143, 145, 176, 72, 8, 432/198–203; 148/712
See application file for complete search history.

(56) References Cited

U.S. PATENT DOCUMENTS

| | | | |
|---|---|---|---|
| 1,451,887 | A | 4/1923 | Novak |
| 2,011,329 | A | 8/1935 | Wayer |
| 2,617,255 | A | 11/1952 | Niehus |
| 2,858,851 | A | 11/1958 | Holl |
| 2,916,878 | A | 12/1959 | Wirt |
| 2,933,895 | A | 4/1960 | Cheeseman |
| 3,011,507 | A | 12/1961 | Hansen |
| 3,295,280 | A | 1/1967 | Kettner |
| 3,429,683 | A | 2/1969 | Jehn |
| 3,533,430 | A | 10/1970 | Fredd |
| 3,678,959 | A | 7/1972 | Liposky |
| 3,774,638 | A | 11/1973 | Kriett |
| 4,030,875 | A | 6/1977 | Grondahl et al. |
| 4,095,418 | A | 6/1978 | Mansson et al. |
| 4,203,458 | A | 5/1980 | Barrett et al. |
| 4,284,103 | A | 8/1981 | Pemberton |
| 4,315,405 | A | 2/1982 | Pidcock et al. |
| 4,343,601 | A | 8/1982 | Thorson |
| 4,454,892 | A | 6/1984 | Chadshay |
| 4,628,694 | A | 12/1986 | Kelm et al. |
| 4,652,476 | A | 3/1987 | Kromrey |
| 4,793,591 | A | 12/1988 | Decker et al. |
| 5,000,005 | A | 3/1991 | Kwan et al. |
| 5,046,702 | A | 9/1991 | Miyazawa et al. |
| 5,050,385 | A | 9/1991 | Hirose et al. |
| 5,137,586 | A | 8/1992 | Klink |
| 5,285,809 | A | 2/1994 | Shimoguri |

(Continued)

FOREIGN PATENT DOCUMENTS

| | | | |
|---|---|---|---|
| DE | 10136196 | A1 | 2/2003 |
| EP | 1734136 | A2 | 12/2006 |

(Continued)

*Primary Examiner* — Scott Kastler
*Assistant Examiner* — Michael Aboagye
(74) *Attorney, Agent, or Firm* — McCormick, Paulding & Huber LLP

(57) ABSTRACT

A method and apparatus for heat treating an article by delivering a heating flow of fluid to a localized region of the article, and simultaneously delivering a cooling flow of fluid to a further region of the article.

5 Claims, 2 Drawing Sheets

(56) References Cited

U.S. PATENT DOCUMENTS

| | | | | |
|---|---|---|---|---|
| 5,331,816 | A | 7/1994 | Able et al. | |
| 5,341,769 | A | 8/1994 | Ueno et al. | |
| 5,405,261 | A * | 4/1995 | Scraggs et al. | 431/171 |
| 5,449,422 | A * | 9/1995 | Pflanz et al. | 148/601 |
| 5,553,455 | A | 9/1996 | Craig et al. | |
| 5,577,379 | A | 11/1996 | Johnson | |
| 5,701,732 | A | 12/1997 | Nesbitt et al. | |
| 5,709,919 | A | 1/1998 | Kranzmann et al. | |
| 5,782,294 | A | 7/1998 | Froemming et al. | |
| 5,799,491 | A | 9/1998 | Bell et al. | |
| 5,957,067 | A | 9/1999 | Dobbeling et al. | |
| 6,050,081 | A | 4/2000 | Jansen et al. | |
| 6,174,389 | B1 | 1/2001 | Mann | |
| 6,182,442 | B1 | 2/2001 | Schmidt et al. | |
| 6,199,371 | B1 | 3/2001 | Brewer et al. | |
| 6,351,949 | B1 | 3/2002 | Rice et al. | |
| 6,438,963 | B1 | 8/2002 | Traver et al. | |
| 6,470,685 | B2 | 10/2002 | Pidcock et al. | |
| 6,770,325 | B2 | 8/2004 | Troczynski et al. | |
| 6,901,757 | B2 | 6/2005 | Gerendas | |
| 6,931,831 | B2 | 8/2005 | Jansen | |
| 7,024,862 | B2 | 4/2006 | Miyake et al. | |
| 7,281,529 | B2 | 10/2007 | Lew et al. | |
| 7,658,201 | B2 | 2/2010 | Salomon | |
| 2002/0026784 | A1 | 3/2002 | Nakamoto | |
| 2002/0184892 | A1 | 12/2002 | Calvez et al. | |
| 2003/0056516 | A1 | 3/2003 | Hadder | |
| 2003/0079475 | A1 | 5/2003 | Schmahl et al. | |
| 2004/0110041 | A1 | 6/2004 | Merrill et al. | |
| 2004/0118127 | A1 | 6/2004 | Mitchell et al. | |
| 2005/0034399 | A1 | 2/2005 | Pidcock et al. | |
| 2005/0238859 | A1 | 10/2005 | Uchimaru et al. | |
| 2006/0070655 | A1 | 4/2006 | Tebby | |
| 2006/0242914 | A1 | 11/2006 | Stephansky et al. | |
| 2007/0028592 | A1 | 2/2007 | Grote et al. | |
| 2007/0028620 | A1 | 2/2007 | McMasters et al. | |
| 2007/0107710 | A1 | 5/2007 | DeSousa et al. | |
| 2007/0234730 | A1 | 10/2007 | Markham et al. | |
| 2007/0246149 | A1 | 10/2007 | Millard et al. | |
| 2007/0289307 | A1 | 12/2007 | Grote et al. | |
| 2008/0099465 | A1 * | 5/2008 | Myers et al. | 219/544 |

FOREIGN PATENT DOCUMENTS

| | | | |
|---|---|---|---|
| EP | 1741891 | A1 | 1/2007 |
| GB | 1503921 | | 3/1978 |
| GB | 2148949 | A | 10/1984 |
| GB | 2353589 | A | 2/2001 |
| GB | 2361304 | A | 10/2001 |
| GB | EP 1734136 | * | 12/2006 |
| JP | 8021687 | A | 7/1994 |

* cited by examiner

GAS HEATER

CROSS REFERENCE TO RELATED APPLICATION

This application is entitled to the benefit of British Patent Application No. GB 0800294.1, filed on Jan. 9, 2008.

FIELD OF THE INVENTION

The present invention relates to a method and apparatus for the treatment of a component. In particular it relates to a method and apparatus used to heat components using a hot fluid.

BACKGROUND OF THE INVENTION

Components require heating for any number of reasons including stress relief, hardening and conditioning. Heat treatment may be global in that the whole component is heated or local in that a selected part of the component is heated.

Heat treatment on a global scale is usually performed using a furnace; this may take the form of a vacuum furnace, inert gas furnace or air furnace depending upon the application and the materials being processed. The furnace may use various types of heating source to raise the temperature of the component.

In the case of a vacuum furnace the transfer is predominantly by radiant heating. In this case the heat generated in the elements is released as infrared radiation, which is then absorbed by the component to raise its temperature.

In an inert gas furnace convection is the principal source of heat transfer. In this example the heat is transferred from the elements to a gas, which then heats the component by a process of conduction as it interacts with it in the furnace. As the gas cools upon contact with the component, it sinks in the furnace and is replaced by hotter gas.

Alternative heat treatment techniques use beds of powder fluidized using a high temperature gas, or baths containing a molten salt.

There are also various methods of localized heat treatment used extensively in industry. The difference between localized and global heat treatment is the requirement for only certain areas of the component to reach the heat treatment temperature while allowing other, temperature sensitive regions to be maintained at a lower temperature. The main methods used for applying local heat treatment are that of radiant heating, convective heating, induction heating and resistance heating.

Forced convection local heat treatment is also known and published in EP1734136 to the applicant. A cassette is placed around the portion to be treated using argon process gas which is heated and impacts upon the component to be heated as impingement jets. These high velocity jets produce high heat transfer due to their turbulent nature as they impact on the component. A feature of this system is that the process gas used to produce the impingement jets can be inert and used in conjunction with a gas atmosphere to facilitate the processing of reactive components such as titanium. The nozzles within the cassette can be configured to selectively supply hot gas or colder gas. Typically, the colder gas is supplied at the periphery of the cassette to inhibit heat spread from the localised treatment. The cassette has sealing means to inhibit the spread of heated gas from the cassette and an evacuation pipe removes used gas from the cassette to enable a continuous flow.

The forced convection system of EP1734136 is particularly suited for processing individual components and particularly localised sections of these components. There is a need, however, to provide a simplified system that enables simultaneous treatment of a number of different regions of components in order to reduce the cycle time required for processing an entire component.

SUMMARY OF THE INVENTION

It is an object of the present invention to seek to address these and other requirements.

According to the invention there is provided a method of heat treating a turbine component, the method comprising the steps of locating the turbine component within an envelope containing a protective atmosphere, taking an amount of the protective atmosphere and delivering it through heating means to deliver a heating flow to a treatment region of the turbine component while simultaneously delivering a cooling flow of fluid taken from the protective atmosphere to a further region of the article to prevent the further region being damaged by the heating flow delivered to the treatment region.

Preferably, the heating flow has a temperature that is sufficient to stress relieve the localised region of the article. Preferably the temperature of the heating fluid supplied to the localised region is around 500° C. to 700° C. The cooling flow preferably keeps to temperature of the region to which it is delivered below 400° C. However, it will be appreciated that other temperatures may be used depending on the functional requirement of the heat treatment. It is important, however, that the cooling fluid has a lower temperature than that of the heating fluid and is applied to location(s) of the article that otherwise would experience a detrimental temperature rise caused by the application of the heating fluid if the cooling fluid was not applied.

Preferably, heating flows of fluid are delivered to multiple localised regions of the article.

The heating flow or flows and the cooling flow may be delivered from a common source. Preferably the common source is a fan. Preferably, the heating flow or flows and cooling flow divide from the common source with the heating flow or flows being heated prior to delivery to their respective localised region.

The heating and cooling flows may be delivered to the article through apertures which create impingement jets of the fluid onto the article. The heating fluid may be an inert gas and the cooling fluid an inert gas.

The article may be a bladed gas turbine component, wherein the or each heating flow of fluid is delivered to an aerofoil portion of the bladed gas turbine component and the cooling flow is delivered to a disc or hub portion of the bladed gas turbine component.

According to a second aspect of the invention there is provided a heat treating apparatus comprising an envelope for locating a turbine article to be treated in a protective atmosphere, the apparatus having means for supplying a protective atmosphere to the envelope, the envelope containing:

a heating fluid delivery means for heating and delivering a flow of the protective atmosphere to a treatment region of an article, wherein the heating fluid delivery means has a heater for heating the fluid and a delivery chamber with apertures for directing the heated fluid towards the treatment region of the article as impingement jets; and a cooling fluid delivery means for simultaneously delivering a cooling flow of protective atmosphere to a further region of the article.

The heat treating apparatus may further comprise further heating fluid delivery means for delivering a heating flow of fluid to further localised regions of the article.

Preferably, the heating flow of fluid and the cooling flow of fluid is supplied to their respective delivery means from a common source. The common source may be a pumping chamber containing a fan.

DETAILED DESCRIPTION OF THE PREFERRED EMBODIMENTS

Figure 1:
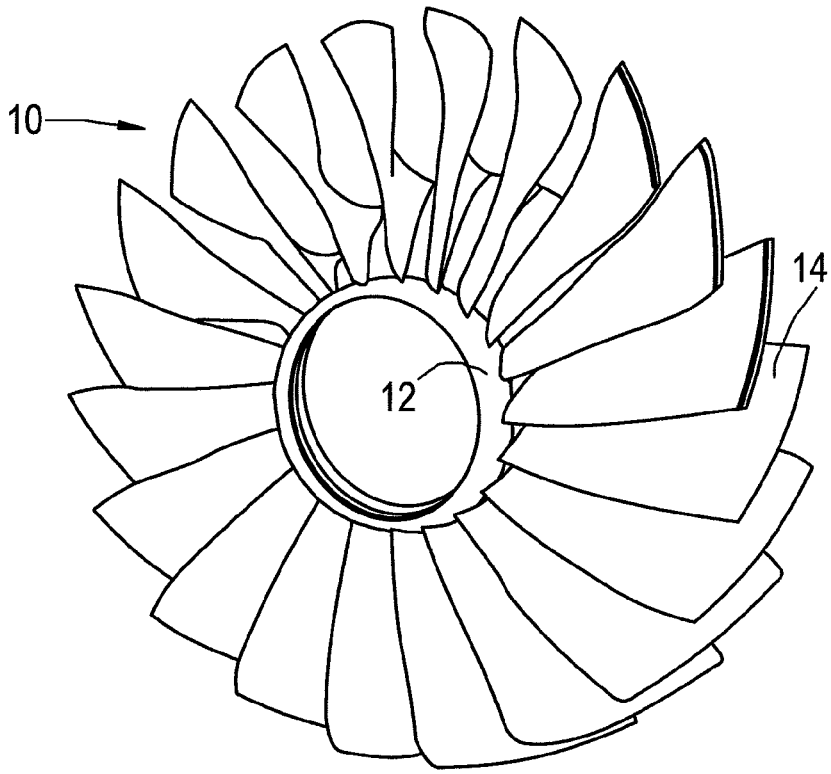
FIG. 1 depicts an integrally bladed rotor disc.

Referring to FIG. 1 an integrally bladed rotor 10 comprises a disc 12 to which individual blades 14 are attached. The rotor 10 is made from titanium and individual blades 14 are attached to the outer surface of the disc 12 by linear friction welding. Alternative methods of blisk manufacture may be by machining from a solid component, for example. In the fabrication process the blades 14 are oscillated relative to the disc 12, which is held stationary. The oscillating blades 14 are brought into contact with the disc 12 whilst a force is applied. The force applied is sufficient plastically deform he material at the interface and weld the blades 14 to the periphery of the disc 12.

If during operation of the engine, a blade 14 in the rotor 10 is damaged the damaged portion has to be removed and replaced by either welding on a replacement part or depositing new material. Once completed the repaired area of the blade 14 must be heat treated to remove any residual stress introduced during the welding or deposition repair process. When the rotor has a Foreign Object Damage (FOD) incident it is more than often the case that a number of aerofoils have been damaged. In order to repair these damaged aerofoils in a cost effective and timely manner, it is beneficial to perform any required heat treatment on a number of aerofoils in one go. However, the heat treatment must not be performed on certain temperature sensitive areas of the component requiring that global heat treatment of the entire component is not possible and that it is the application of heat treatment to multiple portions of the component that is required.

Figure 2:
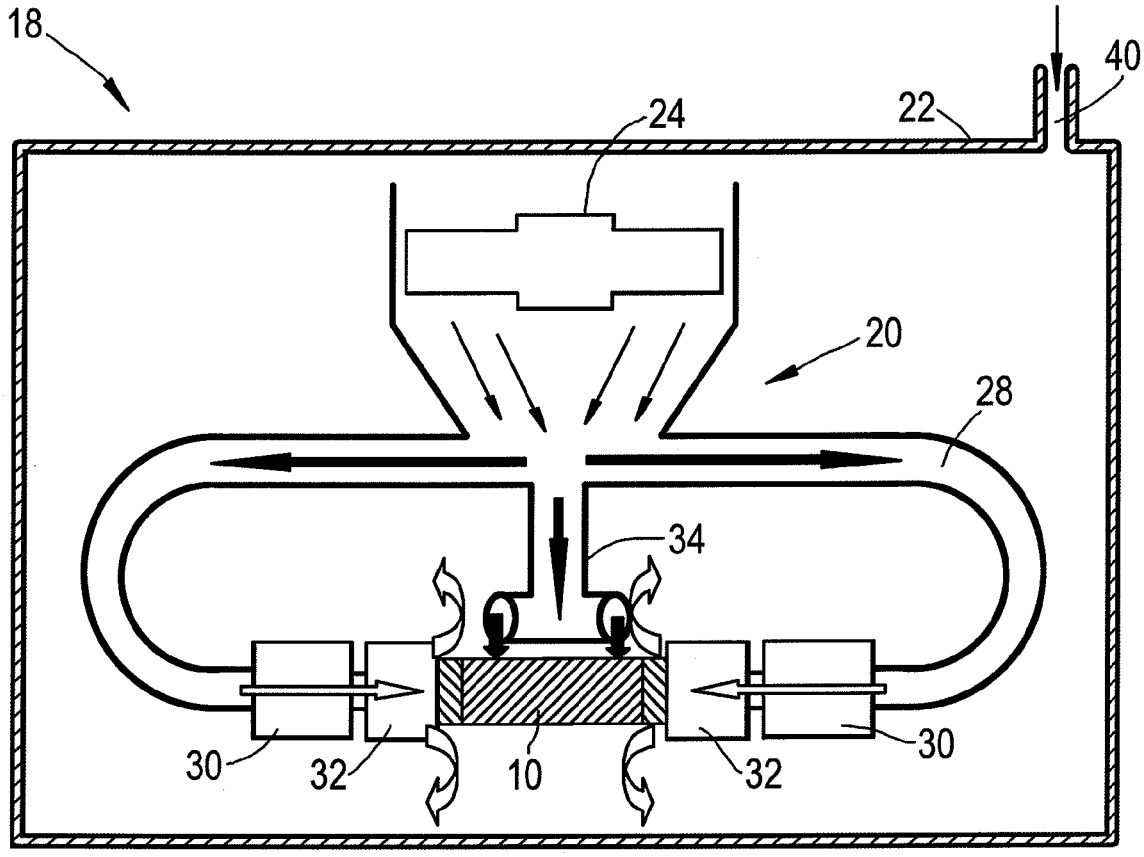
FIG. 2 depicts apparatus for heat treating an article in accordance with the invention.

Exemplary apparatus to achieve the multiple local heat treatments is depicted in FIG. 2 for a heat treatment device 18 using an inert gas such as argon.

A chamber 22 is provided having an internal atmosphere comprising predominantly an inert gas such as argon. Delivery means 20 are placed within the chamber and cause a stream of gas from the main chamber 22 to impinge onto the workpiece 10. A rotating fan 24 is used to draw gas from the local atmosphere into the delivery means. The fan provides gas at the required flow rate and pressure into the system at a sufficient flow rate and pressure to allow impingement jets to be produced.

The gas from the fan flows from a manifold into a series of pipes 28. Two pipes are shown in FIG. 2, but it will be understood that more pipes, as many as required, may be used to transfer gas from the manifold to the component. The pipes may extend in a circumferential array with the manifold being located on the axis of the circumferential array. It is desirable that each of the pipes is of substantially the same shape and size to ensure that a uniform pressure drop and gas delivery is delivered to the component from the end of each pipe. If desired tuning means (not shown) such as valves or constrictions may be provided to maintain or create a uniform delivery by the pipes. The use of valves is preferred since it enables more flexibility within the system allowing selected pipes to be closed or opened depending on the architecture or material of the component to be treated.

Each of the pipes 28 is provided with a heater 30. The heaters consist of a resistive coil that generates heat when a current is applied. As the gas flows through the heater, this heat is passed to the gas as it contacts the coil so that as the gas moves through the heater its temperature is increased. On exiting the heater section the gas will be at, or slightly above the required heat treatment temperature, this is to allow for heat loss as it makes its way to the component.

The heated gas is distributed into a number of plenum chambers 32, which supplies the impingement jets, which supply heat to the component. For the component, it is desirable that there is one plenum chamber for each of the blades 14 to be treated. However, the chambers may be sized such that multiple blades may be contained therein for treatment.

The location of the heaters in sections arranged circumferentially around the component allows the gas to travel the minimum distance from heater to component. Argon has a relatively low specific heat capacity of 0.52 kJ/kgK, compared to air at 1.01 kJ/kgK or Nitrogen at 1.03 kJ/kgK, allowing it to readily lose its heat to the surroundings. By locating the heaters close to the component, the time and distance the gas has to travel after it is heated is minimised and the opportunities for heat loss is similarly minimised.

The position of the manifolds between the heater and the component and the circumferential flow of the gas around the system also helps to reduce the heat loss whilst the gas is in the plenum chamber. The flow may be kept as laminar as possible by removing as many tight bends as possible. The gas temperature is monitored via a thermocouple (not shown) placed in the gas stream within the plenum chamber 32. The gas temperature is related to the component temperature by an offset value, which is determined during system setup. The monitoring gas temperature and the use of an offset value for the temperature mitigates the need to attach anything to the component during processing which may not be an option in the case of critical parts, particularly rotating aero-engine parts such as blisks.

Beneficially, because the gas is heated close to its point of use, the pipework 28 between the manifold 26 and the heater can be made of a material which does not need to have the capability to withstand the high temperature generated within the heater. This increases the options available when selecting the pipework and enables the use of flexible conduits, which simplifies loading of the component 10 within the treatment apparatus 20.

Careful design of the manifold section is required to ensure that the correct flow is supplied to each of the aerofoils in the system. As the number of aerofoils being serviced by one manifold is kept low, heat loss and the chance of having non-uniform flow magnitudes to each of the impingement plates is further mitigated.

The plenum chambers 32 are sized to enclose the region to be treated but not to seal around the region. It is possible to create a high flow rate through the chambers without pressurizing the local area. By selecting an appropriate sized chamber it is possible to easily adapt the system for a given component without having to modify other parts of the system. Each chamber can be a sleeve that is open at one or both ends with the gas supply feeding in from one end or from an inlet positioned between the open ends.

Loose fitting sleeves are desirable particularly where multi-stage bladed rotors require treatment as each stage has different sized aerofoils. The sleeves may be moved between aerofoils whilst the bladed rotor is located within the envelope, which avoids having to evacuate and re-load the envelope with the protective atmosphere if the sleeves are tailored for a specific aerofoil size.

In a bladed rotor formed of titanium the disk or hub area of the component must be kept at a temperature below around 400° C. to mitigate against the risk of alpha case formation which can be life limiting to the component.

The delivery means 20 is provided with a conduit 34, which supplies chamber temperature gas to the temperature sensitive areas of the component. For particularly temperature sensitive parts of the engine, it may be further desirable to provide controlled cooling of this gas flow prior to its supply to the bladed disk 10. In the embodiment shown the main fan 24 supplies the inert gas to both the cooling features and the heating features of the heat treatment device 18. If, however, the required flow rate becomes prohibitively high then a separate fan or other appropriate supply means may used to supply the cooling gas.

Although it is possible to use un-cooled chamber gas for the cooling flow in some circumstances the temperature in the chamber will approach or exceed 400° C. In these circumstances, it is desirable to place a chiller or cooler within the cooling flow conduit to reduce the temperature of the flow.

The heat treatment device has a basic support into which the assemblies of the plenum chamber and jet plates are fitted. Beneficially, the component for treatment can be put into position and the system built around the component. A modular arrangement can be preferable where the treated component has a complex shape, such as that of a bladed disk.

Figure 3A:
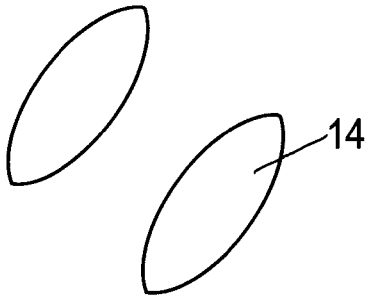
FIG. 3 depicts an assembly method for the heat treating apparatus around a component.
Figure 3B:
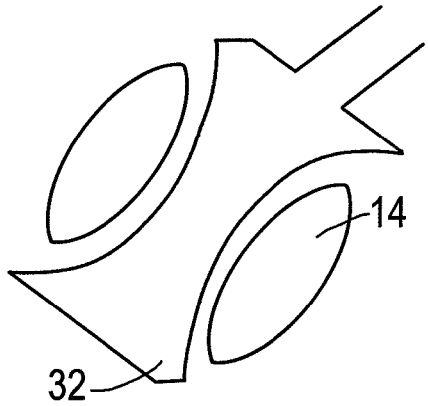
Figure 3C:
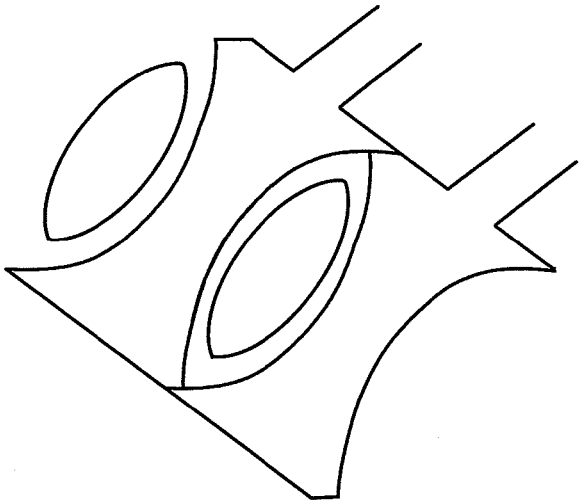

In the embodiment of FIG. 3*a* to 3*d* the disk is placed in position (FIG. 3*a*) and a first plenum section put into position between two aerofoils 14 (FIG. 3*b*). An adjacent plenum 32 is then placed in position to surround the aerofoil 14 (FIG. 3*c*). Once both plenums have been correctly located it is possible to attach the heaters (not shown) and flow manifolds thereto. Each plenum section is shaped to lie close to the aerofoil without touching. Each of the plenums has a plurality of apertures for directing the heated gas to the respective aerofoil. Preferably, each of the plenums is shaped such that it seals against the adjacent plenum so that the heating gas is directed along the blade towards the root or tip.

Figure 3D:
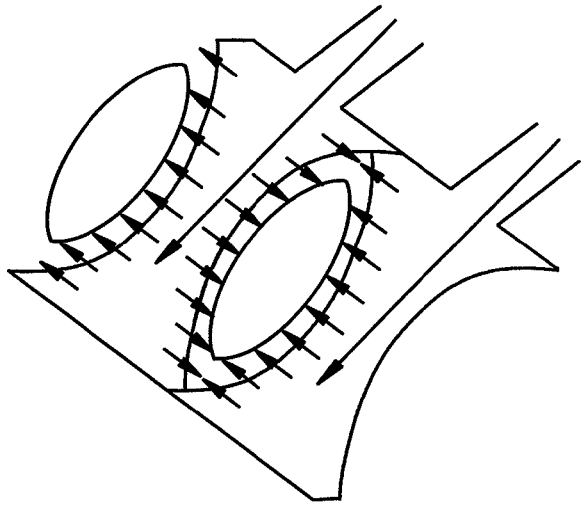

Once the system has been fully constructed, it is possible to turn the gas on and supply the heating fluid to the aerofoil (FIG. 3*d*).

For the heat treatment of contaminant sensitive components, it is desirable that the structure is constructed in a tightly controlled inert atmosphere environment. The manipulation of the components for the construction described can be done using gloves mounted in the side of the unit and which are hermetically sealed on the chamber, minimising oxygen ingress to a predetermined part per million (ppm) level.

As mentioned above, the system can be configured to exhaust the spent gas either towards the root of aerofoils, in which case a baffle system may be required to protect the root regions from attaining too high a temperature. Or it can exhaust down the bottom of the system out of the head unit region in a vertical manner, or both. Whichever system is utilised the spent gas is released into the chamber from which it was originally taken. The high surface area and conductivity of the chamber walls allow any residual heat left in the gas to be removed on contact. Cooling of the external walls can be used, if required, to further reduce the temperature of the gas in the chamber. This gas is then recirculated and used once more in the process.

For a typical aerofoil in this embodiment, a flow rate of argon of around 80 l/min is required to process each aerofoil, translating into a total of around 0.04 m3/s of argon to process an entire blisk. A fan/impeller with a working volume of around 0.007 m3 (i.e. 300 mm dia, 100 mm depth), needs to operate at around 340 rpm to deliver the required flow rate for the process.

The rotational velocity of the fan required to produce the relevant flow rate can be calculated from the following equation:

$$N \times Q_r / 1000 \pi d_f r_f^2 = \text{Fan } RPM$$

Where;

N=Number of aerofoils on a blisk $Q_r$=Flow rate required per aerofoil to achieve required temperature (including required cooling flow)

$d_f$=Fan depth (working depth)

$r_f$=Fan radius (working radius)

Beneficially, the system provides apparatus, which performs precise and controllable heat treatment cycles.

The system offers the ability to process a number of aerofoils at once whilst being flexible enough to apply differing heating patterns to each aerofoil from the same input flow rate. The use of tailored jet plates around each aerofoil allows the system to be configured in such a way as to allow different temperature distributions to be applied to different areas of the component.

By changing the geometry of the holes the velocity of the impingement jet leaving the jet plate is affected. The geometry may be selected to increase the volumetric flow of gas to specific points of the blisk. The velocity and the standoff distance between the jet plate and the aerofoil can be altered to control the heat transfer at various areas of the aerofoil by directing higher velocity jets at the locations requiring the largest heat input.

Beneficially, the system does not contain any high temperature moving parts and allows one constant flow rate to be distributed as required for each aerofoil. To further increase the flexibility of the system, the heaters can be independently controlled in terms of temperature, allowing a different level of heat input into the process gas before it enters the head unit.

As the component to be processed sits entirely within the chamber and draws its gas supply, as well as exhausts, to the chamber it is a fully recycling system there may be a trickle feed replenishment to make up for minor leakage and to help maintain a positive pressure within the chamber. Titanium scrubbers can be provided to the chamber to remove any excess oxygen within the system. These are high temperature (higher than the processing temperature) blocks of high surface area titanium, which act to preferentially attract and absorb oxygen within the system. A filter may be required before the fan to prevent contaminant particles from continually flowing through the system.

The modular design allows various jet arrays to be used in one run, for example if a different repair on different aerofoil requires different heating patterns. This can be easily accommodated by the system, making it completely configurable to any repair situation on that blisk. It is usual that the vast majority of blades on a given blisk are damaged during a foreign object incident. This method of applying local heat treatment is significantly more efficient in terms of time and therefore resource as a conventional local heat treatment device used on a discrete aerofoil-by-aerofoil basis. Beneficially, as the heaters may be individually controlled, thermal expansions can be balanced around the circumference helping to ensure circularity of the blisk.

Beneficially, the ability to tailor heating patterns and gas temperature in various sections of the blisk make it easier to control any thermally induced stress from locally heating the component. Additionally, several areas of a component can be heated at different rates (or be left unheated) and to different temperatures to minimise the distortion or thermal shock experienced. This process allows some areas of the component to relax and redistribute residual stresses built up during previous processing steps.

The separate cooling fixture allows more flexible arrangement and the protection of any temperature sensitive areas of the component.

Whilst the exemplary system outlined above has been described in relation to a blisk and in particular whole blade treatment of a blade, the same arrangement can be used with a modification such as baffles, for example, to facilitate the heat treatment of trailing and/or leading edges of an aerofoil.

Although the description mentions argon as a process gas, any gas can be used within this system.

The system itself could be configured to enable its application for the processing of dual microstructure components, both blisks and discs. The flexible nature of the setup and design allows various regions of a component to be processed at different temperatures. In the example of a dual microstructure component, this could manifest itself as one area being treated at a temperature most applicable to promoting grain growth whilst another region is heated at a temperature more suited to grain nucleation. This will produce a component with different grain sizes at specific areas and the use of cooling to be employed to control the zone of transition between the two grain sizes.

The invention can be used for treating components other than blisks and aerofoils. The configuration is not limited to an annular shape, any appropriate arrangement of manifolds is acceptable, for example a linear arrangement could be manufactured for the heat treatment of various welded sections of a pipe line. As long as the fan or fans within the system can achieve the flow rate requirements then the basic principle could be applied across many fields.

For example, the system could also be applied to various aero-engine components such as vanes and casings or outside the gas turbine field, any area where heat is required for application to multiple small sections could utilise this technique.

The application of this system is not limited to stress relieving heat treatments of titanium; it could also be applied to any situation where high temperature processing of multi-components is required. For example, sintering or brazing could be performed using the same principle (for example for Nozzle Guide Vanes), but designed in slightly different geometrical arrangement. Processing of other materials requiring long heat treatments also lend themselves to this type of system. The fact that the gas is used and then returned back into the atmosphere ready to be used again and not exhausted to the shop floor and lost meaning that longer cycle times are more cost effective when high flow rates are required. For example, in the case of Nickel alloy heat treatments, it is often the case that high temperatures (high flow rates) are required for long periods, thus making this system potentially advantageous.

The self-contained nature of the gas enclosure allows control of gas contamination, for example the maintenance of low partial pressures of oxygen (which could include the facilitation of preferential oxidation for oxygen capture termed gettering) and low leak rates.

What is claimed is:

1. A heat treating apparatus comprising an enclosed envelope for locating a turbine article to be treated in a protective atmosphere, the apparatus having means for supplying a protective atmosphere to the enclosed envelope, the enclosed envelope containing:

a pumping chamber having a fan which simultaneously delivers fluid to multiple fluid conduits connected to the pumping chamber, each conduit having a separate outlet;

wherein at least one of the fluid conduits has a heater which heats fluid in the conduit before delivery of the fluid to an outlet which supplies a plenum chamber having a plurality of apertures for directing the heated fluid towards a treatment region of the article as impingement jets; and wherein at least another of the fluid conduits is arranged to deliver a cooling flow of the protective atmosphere from the pumping chamber to an outlet outside the plenum chamber and directed at a further region of the article outside the plenum chamber, at the same time as the one of the fluid conduits delivers the heated fluid to the plenum chamber, wherein the turbine article is a bladed gas turbine component, the treatment region includes an aerofoil thereof and the further region includes a disc or hub on which the aerofoil is mounted.

2. A heat treating apparatus according to claim 1, wherein additional fluid conduits have heaters and are configured for delivering heating flows of fluid to further treatment regions of the article.

3. A heat treating apparatus according to claim 1, wherein the plenum chamber is located between two aerofoils and an adjacent plenum chamber is provided on an opposite side of the aerofoil.

4. An apparatus according to claim 3, wherein the plenum chamber and the adjacent plenum chamber surround the aerofoil and seal against each other.

5. An apparatus according to claim 1, wherein the plenum chamber is a sleeve open at least at one end and which exhausts spent gas towards a root of the aerofoil, and a baffle system is provided to protect the root.

* * * * *